US010092916B2

(12) United States Patent
Pfau et al.

(10) Patent No.: US 10,092,916 B2
(45) Date of Patent: Oct. 9, 2018

(54) HIGH ROTATION ATOMIZER FUNCTIONING WITH INTERNAL CHARGING

(71) Applicant: EISENMANN SE, Boeblingen (DE)

(72) Inventors: Joerg Pfau, Boeblingen (DE); Jan Reichler, Constance (DE)

(73) Assignee: EISENMANN SE, Boeblingen (DE)

( * ) Notice: Subject to any disclaimer, the term of this patent is extended or adjusted under 35 U.S.C. 154(b) by 0 days.

(21) Appl. No.: 15/101,524

(22) PCT Filed: Nov. 13, 2014

(86) PCT No.: PCT/EP2014/003048
§ 371 (c)(1),
(2) Date: Jun. 3, 2016

(87) PCT Pub. No.: WO2015/082040
PCT Pub. Date: Jun. 11, 2015

(65) Prior Publication Data

US 2016/0303589 A1 Oct. 20, 2016

(30) Foreign Application Priority Data

Dec. 3, 2013 (DE) ..... 10 2013 022 282

(51) Int. Cl.
*B05B 5/053* (2006.01)
*B05B 5/04* (2006.01)
*B05B 12/08* (2006.01)

(52) U.S. Cl.
CPC ..... *B05B 5/053* (2013.01); *B05B 5/0407* (2013.01); *B05B 5/0415* (2013.01); *B05B 12/08* (2013.01)

(58) Field of Classification Search
CPC ..... B05B 5/503; B05B 5/0415; B05B 5/0407; B05B 12/08; B05B 5/053; B05B 5/0531;
(Continued)

(56) References Cited

U.S. PATENT DOCUMENTS 4,402,030 A 8/1983 Moser et al.
5,735,958 A 4/1998 Mauchle
(Continued)

FOREIGN PATENT DOCUMENTS

DE 33 05 058 A1 9/1983
DE 195 11 255 A1 10/1995
(Continued)

*Primary Examiner* — Alexander Valvis
*Assistant Examiner* — Tuongminh Pham
(74) *Attorney, Agent, or Firm* — Schroeder Intellectual Property Law Group, LLC

(57) ABSTRACT

A high rotation atomizer functioning with inner charging includes a high-voltage circuit which generates a high voltage that can be applied to a bell cup, from a low voltage. This high-voltage circuit includes a measuring resistor in a circuit path between the turbine casing of the turbine driving the bell cup and ground. A first measuring voltage can be tapped at this first measuring resistor, which voltage is a measure for the voltage applied at the turbine casing. A second measuring resistor is placed in a circuit path between the turbine casing and ground. A second measuring voltage is tapped at this resistor, which is likewise a measure for the voltage applied at the turbine casing. If the information gained from the two measuring voltages deviates too strongly from each other, then the control device triggers an error signal. By this means, the safety of the entire system is increased.

4 Claims, 1 Drawing Sheet

(58) Field of Classification Search
CPC ... B05B 5/0533; B05B 5/0535; B05B 5/0537; B05B 5/0538; B05B 5/06; B05B 5/10; B05B 5/1608
USPC ..... 239/690, 691, 3, 690.1, 692; 700/258
See application file for complete search history.

(56) References Cited

U.S. PATENT DOCUMENTS

| | | | | |
|---|---|---|---|---|
| 5,908,162 | A * | 6/1999 | Klein | B05B 5/032 118/671 |
| 6,381,109 | B1 | 4/2002 | Burtin et al. | |
| 6,672,521 | B2 | 1/2004 | Reichler | |
| 7,835,125 | B2 | 11/2010 | Freiburger et al. | |
| 2003/0001032 | A1 | 1/2003 | Reichler | |
| 2005/0040262 | A1* | 2/2005 | Nagai | B05B 5/0407 239/690 |
| 2006/0081729 | A1 | 4/2006 | Nagai | |
| 2008/0007307 | A1 | 1/2008 | Freiburger | |
| 2010/0145516 | A1 | 6/2010 | Cedoz et al. | |
| 2011/0107966 | A1* | 5/2011 | Yamada | B05B 3/1035 118/694 |
| 2014/0245951 | A1 | 9/2014 | Yamada | |

FOREIGN PATENT DOCUMENTS

| | | | |
|---|---|---|---|
| DE | 199 03 824 | A1 | 9/2000 |
| DE | 696 12 795 | T2 | 4/2002 |
| DE | 100 53 292 | C1 | 5/2002 |
| DE | 10 2005 049 234 | A1 | 4/2006 |
| DE | 10 2006 024 311 | A1 | 11/2007 |
| DE | 10 2008 008 201 | A1 | 8/2009 |
| EP | 0 753 350 | A1 | 1/1997 |
| WO | 2013/111664 | A1 | 8/2013 |

* cited by examiner

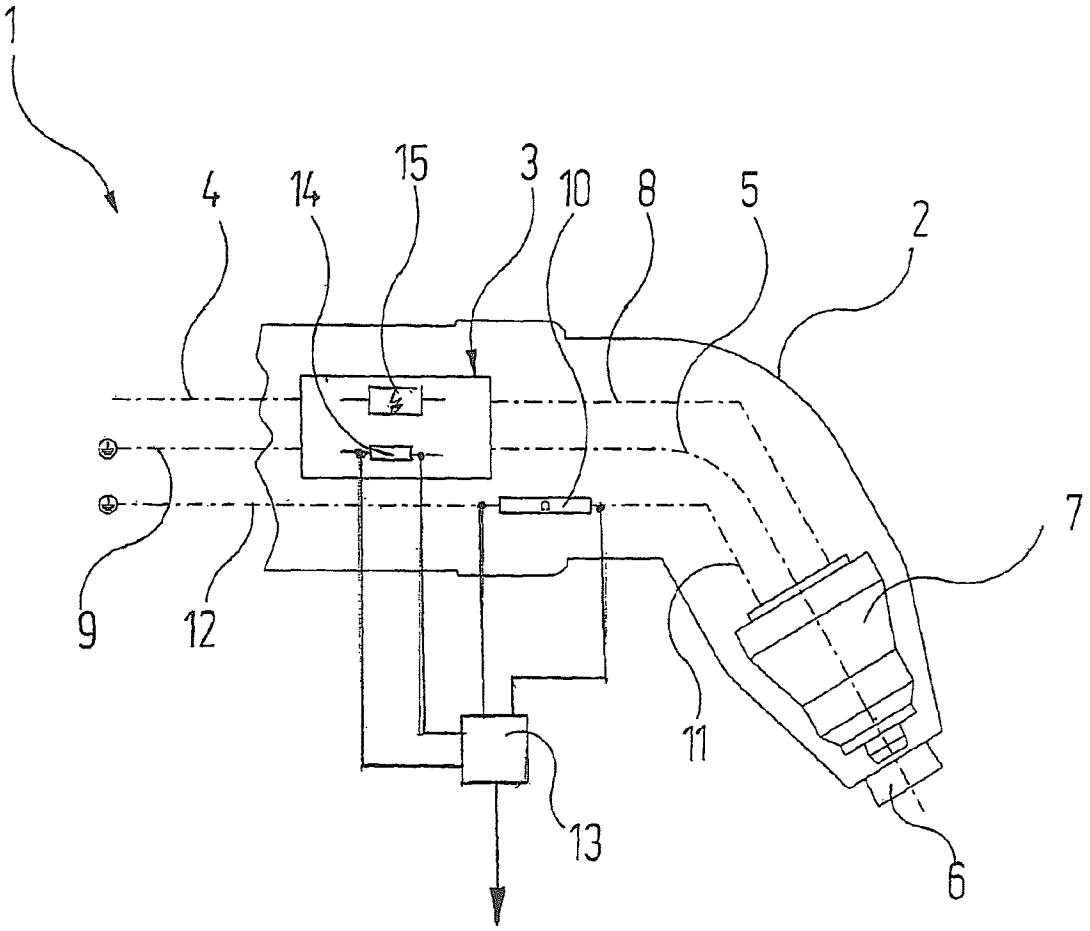
1
4
15
14
3
10
8
5
2
7
6
9
12
13
11

HIGH ROTATION ATOMIZER FUNCTIONING WITH INTERNAL CHARGING

RELATED APPLICATIONS

This application is a national phase of International Patent Application No. PCT/EP2014/003048, filed Nov. 13, 2014, which claims the filing benefit of German Patent Application No. 10 2013 022 282.6, filed Dec. 3, 2013, the contents of both of which are incorporated herein by reference.

FIELD OF THE INVENTION

The invention relates to a high-rotation atomizer functioning with internal charging with:

a) an outer casing;

b) a rotatably mounted bell disc;

c) a turbine arranged in a turbine casing, which causes the bell disc to rotate;

d) a high-voltage circuit, to which a low voltage can be supplied and which generates a high voltage at an output that has been electrically connected to the bell disc, to the turbine and to the turbine casing, and comprises:

da) a high-voltage cascade;

db) a measuring resistor which is situated in a current path situated between the turbine casing and earth and at which a first measuring voltage can be tapped which is a measure of the voltage applied to the turbine casing.

BACKGROUND OF THE INVENTION

Practically all the currently known high-rotation atomizers on the market that function with internal charging have this type of construction, so evidence in the form of a printed publication can be dispensed with. High-rotation atomizers exhibit, a certain hazard potential by reason of the high voltage which is present in them, and therefore have to be carefully monitored. One hazard may, for example, consist in the fact that the turbine casing, which in operation is at the high voltage, does not discharge rapidly and/or fully enough after the de-energising of the high-voltage circuit, so that a potentially dangerous high voltage still remains on it.

For this reason, the known high-rotation atomizers of the type mentioned in the introduction possess the aforementioned 3.0 measuring resistor in their high-voltage circuit. In operation—that is to say, when the high-voltage circuit has been energised—the first measuring voltage dropping at said resistor is utilised for the purpose of regulating the high voltage. After the de-energising of the high-voltage circuit, is the first measuring voltage serves for establishing the residual high voltage that is still applied to the turbine casing—that is to say, as a safety measure.

Although this safety measure is generally highly effective, generally there is a need to reduce further the risk potential that stems from a high-rotation atomizer.

SUMMARY OF THE INVENTION

In accordance with the invention, this object is achieved in that e) a further measuring resistor has been provided which is likewise situated in a current path leading from the turbine casing to the earth, and at which a second measuring voltage can be tapped which is a measure of the voltage applied to the turbine casing;

f) a control device has been provided, to which the two measuring voltages can be supplied and which emits an interference signal when a maximum value of the difference of these measuring voltages is exceeded.

So, in accordance with the invention a redundant monitoring of the voltage applied to the turbine casing and to all the electrically conducting components electrically connected thereto is created which is independent of the already existing high-voltage circuit. If in this second measuring channel an excessive deviation from the item of information obtained in the first measuring channel concerning the voltage on the turbine casing is established, an interference signal is emitted at once. By virtue of this redundant measure, the safety of the operating personnel and of the entire plant can be considerably enhanced.

By virtue of the interference signal of the control device, an optical or acoustic fault signal can preferentially be triggered. By this means, the operating personnel are alerted without delay to the existence of a hazard, so that they can withdraw from the hazardous zone and/or can take other suitable measures.

It is expedient, furthermore, if the supply of voltage to the high-voltage circuit can be switched off by the interference signal of the control device. This measure reduces considerably the hazard stemming from a faulty high-rotation atomizer.

Finally, it is possible that the safety function of a higher-ranking plant control system can be activated by the interference signal of the control device. Understood by the term 'higher-ranking' plant control system is the control system that monitors and regulates the entire coating process brought about with the high-rotation atomizer. This process includes, for example, the safety precautions at the doors that enable access to the rooms in which the rotation atomizer is operating.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An embodiment of the invention will be elucidated in more detail in the following on the basis of the drawing; the single FIGURE shows, schematically in section, the head region of a high-rotation atomizer.

DETAILED DESCRIPTION OF THE PRESENT INVENTION

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The high-rotation atomizer labelled overall by reference symbol 1 possesses an outer casing 2 in which the elements described below are accommodated:

Denoted by reference symbol 3 is a high-voltage circuit such as is known in principle from the state of the art. With the aid of a schematically represented high-voltage cascade 15, said high-voltage circuit generates from a low, medium-frequency AC voltage, for example 24 to 36 V and 35 kHz, which is supplied to it via line 4, a high voltage such as is required for operating a high-rotation atomizer. Said high voltage is applied to a bell disc 6 via a line 5. The bell disc 6 is caused to rotate in known manner by a turbine which has been mounted in a turbine casing 7 which is discernible in the drawing. In the case of high-rotation atomizers functioning with internal charging, the same high voltage is applied in operation to the turbine and to the turbine casing 7.

Not represented are the pneumatic lines that are required for operating the turbine, as well as the line via which the paint to be sprayed is fed to the bell disc 6. These lines are known to a person skilled in the art.

The high-voltage circuit 3 includes, likewise corresponding to the state of the art, a measuring resistor 14. The latter is indicated in the drawing only schematically. One terminal of this measuring resistor 14 has been earthed via a line 9; the other has been connected to the turbine casing 7 via a line 8. The first measuring voltage dropping at the measuring resistor 14 is ascertained by a monitoring circuit likewise provided in the high-voltage circuit 3. The high voltage applied to the bell disc 6 is regulated in operation in accordance with this first measuring voltage. After the de-energising of the high-voltage circuit 3, further measures are triggered when a defined value of this first measuring voltage is exceeded. These processes are also known to a person skilled in the art and therefore do not need to be described here in any detail.

Not present in the state of the art, on the other hand, is a second measuring resistor 10 which at one terminal has likewise been connected to the turbine casing 7 via a line 11 and at the other terminal has been earthed via a line 12. The second measuring voltage dropping at the second measuring resistor 10 is therefore likewise a measure of the voltage that is applied to the turbine casing 7.

Both the first and the second measuring voltage are supplied to a control device 13. Said control device compares the items of information obtained via two measuring channels with one another. If, as a result, these items of information differ from one another beyond a defined maximum value, this means that a fault is present in one of the two measuring channels. In this case, an interference signal is generated which warns the operating personnel and prompts them to adopt suitable measures. In addition, the high voltage can be switched off automatically.

If the control device 13 or the monitoring circuit in the high-voltage circuit 3 establishes too high a value of the voltage on the turbine casing 7, it likewise emits a suitable interference signal with which substantially the same effects as described above may be associated.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A high-rotation atomizer functioning with internal charging comprising:

a) an outer casing;

b) a rotatably mounted bell disc;

c) a turbine arranged in a turbine casing, which causes the bell disc to rotate;

d) a high-voltage circuit, to which a low voltage is supplied and which generates a high voltage at an output that has been electrically connected to the bell disc, to the turbine and to the turbine casing, and comprises da) a high-voltage cascade;

db) a first measuring resistor connected to the turbine casing, the first measuring resistor being situated in a current path situated between the turbine casing and earth and at which a first measuring voltage is tapped which is a measure of the voltage applied to the turbine casing;

wherein e) a second measuring resistor is connected to the turbine casing, the second measuring resistor likewise being situated in a current path leading from the turbine casing to the earth, and at which a second measuring voltage can be tapped which is a measure of the voltage applied to the turbine casing so that both the first measuring resistor and the second measuring resistor measure the voltage applied to the turbine casing along separate lines;

f) a control device has been provided, to which the first and second measuring voltages are supplied and which emits an interference signal when a maximum value of the difference of the measured voltages applied to the turbine casing as measured by the first and second measuring resistors is exceeded.

2. The high-rotation atomizer according to claim 1, further comprising an optical or acoustic fault signal which is triggered by the interference signal of the control device.

3. The high-rotation atomizer according claim 1, wherein the low voltage supplied to the high-voltage circuit is switched off by the interference signal of the control device.

4. The high-rotation atomizer according claim 1, wherein a safety function of a higher-ranking plant control system is activated by the interference signal of the control device.

* * * * *